United States Patent [19]

Winter et al.

[11] 3,945,860

[45] Mar. 23, 1976

[54] PROCESS FOR OBTAINING HIGH DUCTILITY HIGH STRENGTH ALUMINUM BASE ALLOYS

[75] Inventors: Joseph Winter, New Haven; Michael J. Pryor, Woodbridge; William C. Setzer, Hamden, all of Conn.

[73] Assignee: Swiss Aluminium Limited, Chippis, Switzerland

[22] Filed: Dec. 23, 1974

[21] Appl. No.: 535,754

Related U.S. Application Data

[63] Continuation of Ser. No. 140,580, May 5, 1971, abandoned.

[52] U.S. Cl. ..... 148/11.5 A; 148/12.7

[51] Int. Cl.[2] ..... C22F 1/04

[58] Field of Search ..... 148/12.7, 11:5 A

[56] References Cited

UNITED STATES PATENTS 3,232,796 2/1966 Anderson ..... 148/12.7

*Primary Examiner*—W. Stallard

*Attorney, Agent, or Firm*—Robert H. Bachman

[57] ABSTRACT

The present invention relates to aluminum base alloys having high strength and high ductility prepared by working at a temperature of from 450° to 950°F, working at a temperature below 450°F, holding at from 250° to 650°F, and working at a temperature below 450°F.

8 Claims, No Drawings

PROCESS FOR OBTAINING HIGH DUCTILITY HIGH STRENGTH ALUMINUM BASE ALLOYS

This is a continuation, of application Ser. No. 140,580, filed May 5, 1971, and now abandoned.

The present invention relates to a process for the preparation of high strength aluminum base alloys having high ductility. In particular the present invention resides in a process for the preparation of aluminum alloys having ductilities considerably higher than are conventionally obtained at high strength levels.

It is naturally highly desirable to conveniently obtain high strengths and high ductilities in aluminum base alloys, especially in those common, inexpensive, commercially available aluminum base alloys.

Various processes are generally known for increasing the strengths of aluminum base alloys. For example, U.S. Pat. No. 3,490,955 describes a process of producing an alloy having increased strength.

Other conventional processes are also generally known but many of the processes are expensive and cumbersome or characterized by a plurality of process steps which are inconvenient and expensive to utilize. In addition, conventional processes are frequently characterized by critically defined process conditions which makes the process inconvenient to operate on a commercial scale. Furthermore, processes for increasing the strength of aluminum base alloys are frequently selectively based on particular alloying ingredients present in the alloy and are not often utilizable over a wide range of aluminum base alloys.

In addition to the foregoing, processes for increasing the strength of aluminum base alloys still frequently leave much to be desired with respect to the ultimate strength obtained. In addition, conventional processes often increase the strength of the aluminum base alloy with attendant losses of other desirable physical properties such as ductility thereby often improving one property with an attendant degradation of another.

It is therefore an object of the present invention to provide a process for preparing aluminum base alloys having improved ductility at high strength levels.

It is an additional object of the present invention to provide an improved alloy and process as aforesaid which is inexpensive and convenient and readily feasible on a commercial scale.

It is a still further object of the present invention to provide an improved alloy and process as aforesaid which attains greatly improved strength characteristics without inordinate loss of desirable physical properties, for example, electrical properties and finishing characteristics.

Additional objects and advantages of the present invention will appear hereinafter.

In accordance with the present invention, it has now been found that the foregoing objects and advantages may be readily attained and an improved alloy and process conveniently provided.

The process of the present invention comprises:

A. providing an aluminum base alloy containing from 0.05 to 1.0% iron, from 0.05 to 1.0% silicon, at least one material selected from the group consisting of less than 10.0% magnesium, less than 3.0% manganese, less than 1.0% copper, less than 0.5% chromium, less than 0.5% zinc, less than 0.5% zirconium, less than 0.5% titanium, less than 0.1% boron, others less than 0.5% each, total less than 1.5%, balance essentially aluminum;

B. working said alloy, preferably by rolling, extruding, or drawing, at a temperature between 450°F and 950°F, and preferably between 550° and 850°F, to a total reduction in excess of 20%;

C. working said alloy, preferably by rolling, extruding, or drawing, at a temperature below 450°F with a total reduction in excess of 20%;

D. holding said alloy at a temperature of from 250° to 650°F for a period of time no greater than defined in the following formula: $T(8.95 + \log t) = 5{,}700$, wherein T is temperature in degree Kelvin and t is the maximum time in minutes at temperature T, so that there is no recrystallization throughout the matrix and so that there is less than 10% loss in tensile strength; and E. repeating step (C), preferably repeating steps (C) and (D) preferably a plurality of times.

In accordance with the present invention it has been found that the foregoing process results in a surprising improvement in strengths, while maintaining high ductility even in the common aluminum alloys, and even with the introduction of thermal treatments after severe amounts of cold working. For example, high tensile properties have been reproducibly obtained in combination with high ductilities, generally in excess of, for example, at least 5% when steps (C) and (D) are repeated thereby giving surprisingly improved ductility at high strength levels, i.e. at tensile strengths of 55,000 to 70,000 psi.

In general, the present invention is broadly applicable to a wide range of aluminum base alloys as stated above, including high purity aluminum, and significant improvement is obtained with all these materials. It is preferred, however, that the aluminum base alloy contain less than 99.5% aluminum and naturally that certain additional elements be present in the alloy. This is reflected in the following which shows the permissible and preferred amounts of additional elements wherein all percentages are percentages by weight: Silicon from 0.05 to 1.0%, preferably from 0.3 to 0.7%; iron from 0.05 to 1.0%, preferably about 0.1 to 0.8%. In addition to iron and silicon, the alloy must contain at least one of the following materials; copper from 0 to 1.0%, preferably from 0.1 to 0.5%; manganese from 0 to 3.0%, preferably from 0 to 1.6%; magnesium from 0 to 10.0%, preferably from 0.1 to 5.0%; chromium from 0 to 0.5%, preferably from 0.1 to 0.25%; zinc from 0 to 0.5%, preferably from 0.05 to 0.3%; zirconium from 0 to 0.5%; preferably 0.002 to 0.3%; boron from 0 to 0.1%; titanium from 0 to 0.5%, preferably from 0 to 0.2%; others each less than 0.5%, total less than 1.5%, preferably each less than 0.05%, total less than 0.15%. In general the preferred alloys are those of the 1000 series, 3000 series and 5000 series.

In accordance with the present invention, the aluminum base alloys may be cast in any desired manner. The particular method of casting is not critical and any commercial method may be employed, such as Direct Chill or Tilt Mold casting.

After casting it is preferred in accordance with the present invention to provide a homogenization or solutionizing treatment. The homogenization treatment temperature depends upon the alloy but should be performed at a temperature above 850°F and in the single phase region for the major constituents. The casting should be held at temperature for a minimum of 4 hours. After the homogenizing or solutionizing step, the ingot should be rapidly cooled to below 450°F and preferably rapidly cooled to below 250°F at a rate of above 400°F per hour.

In accordance with the present invention, if desired, the solutionizing step may be in combination with the casting operation, i.e., in the casting operation the material may be cooled from the solidification temperature.

The purpose of the solutionizing step is as follows: When the aluminum base alloy contains alloying additions as indicated hereinabove, the solutionizing step followed by rapid cooling puts as much of these materials into solution as possible. Thus, the solute elements or alloying additions are in solid solution, preferably to the maximum degree, in the aluminum or solvent matrix. This is, as stated hereinabove, a preferred operation.

In accordance with the present invention, the next steps are the critical working operations. The preferred type of working operation is by rolling and the present specification will be particularly directed to this form of working. It should be understood, however, that the other types of working are contemplated, such as drawing, swaging, or extruding.

As a critical step, the material is first worked, e.g., by rolling at a temperature between about 450°F and 950°F with a total reduction in excess of 20%. It is preferred to roll at a temperature between 550° and 850°F and the material may be rolled in one or more passes. Throughout the present specification, the term "reduction" means total reduction in area.

It is this critical rolling step which surprisingly and unexpectedly provides for the increased ductility of the alloy at high strength levels not shown in the art.

The material is then worked at a temperature below 450°F with a total reduction in excess of 20%. It is preferred to work at a temperature below 375°F. In general, it is preferred to take a plurality of smaller reductions of at least a 15% reduction rather than one large reduction. A total reduction may be large if desired. For example, total reduction in excess of 99% may be taken, e.g., in wire form.

After the rolling or working step the material is critically held at from 250 to 650°F for a period of time no greater than defined in the following formula: $T(8.95 + \log t) = 5{,}700$, wherein T is any given temperature within the foregoing temperature range in degrees Kelvin and $t$ is the maximum time in minutes at temperature T. The minimum time at temperature is not particularly critical, but should be at least one second. Naturally, the higher the temperature within the foregoing temperature range, the shorter is the maximum holding time and the lower the temperature the longer the maximum holding time. It is preferred to operate in the temperature range of from 250° to 450°F. Examples of maximum allowable times determined in accordance with the foregoing formula are: approximately 400 hours at 300°F; approximately 16 hours at 400°F; and 2 minutes at 650°F.

As indicated above, after the rolling or working step the materials is critically held at from 250°F to 650°F for no longer than the time determined by the foregoing empirical equation for which the constants were determined experimentally. It is interesting to note that changing the form of this equation to $1/t = \exp(-Q/RT)$ gives a value of Q, the activation energy, that is slightly lower than is required for recrystallization in aluminum. This indicates that the initiation of recrystallization is the upper limit for the thermal treatment.

Subsequent to the thermal treatment, the material is worked or rolled again at a temperature below 450°F with a total reduction of at least 20% in the same manner as indicated hereinabove. This second rolling or working step may then be followed by an additional thermal treatment at from 250° to 650°F as indicated hereinabove if it is so desired.

Cold working after a low temperature thermal treatment is unusual in the fabrication of wrought aluminum structures inasmuch as low temperature treatment or partial annealing are normally introduced to stabilize the structure or lower the strength to desired levels in order to meet specific properties. In fact, the 'H2X and 'H3X standards of the Aluminum Association specifies work hardening and partical annealing or work hardening and then stabilizing. In accordance with the present invention, however, hot working followed by cold working below 450°F and a stabilizing or partial annealing treatment as a preparatory step for subsequent cold working below 450°F provides the significant mechanical property increase in combination with high ductility at the increased strength levels attained, of the present invention.

It is preferred to repeat the cold rolling below 450°F and thermal treatment steps a plurality of times, preferably from 3 to 5 times. In accordance with the present invention, the final step in the process may be a thermal treatment operation.

A modification of the present invention includes the following. If desired, the cold rolling step may be performed within the thermal treatment range. Thus, where one rolls at a temperature of from 250° to 450°F and holds the material at temperature one may effectively combine the working or rolling step with the thermal treatment step and thereby avoid a separate thermal treatment step.

An additional modification includes the following: The final step may optionally be a low temperature thermal treatment below 250°F or the holding step of the present invention at from 250° to 650°F as permitted by the foregoing formula, so that there is no recrystallization throughout the matrix but there is less than 25% loss in yield and tensile strength. This would result in yield and tensile strengths still greatly superior than normally obtained, and with the ductility increased.

In accordance with the present invention the first cold forming operation forms a cellular sub-grain structure. That is, the microstructure of the alloy is characterized by grains within grains. The thermal treatment step tends to stabilize the sub-grain walls by migrating solute atoms towards the sub-grain walls. The second cold deformation forms more sub-grain walls within the sub-grain structure, thereby incrementally refining the sub-grain size as deformation and thermal treatment steps are repeated.

Thus, the improved alloys of the present invention are characterized by greatly and surprisingly improved ductilities in combination with high strength characteristics and ultra fine sub-grain structure with the sub-grain size being 0.001 mm or smaller. Furthermore, the sub-grain structure is quite stable. The alloys of the present invention are also characterized as follows. The sub-grains have boundary walls of pinned dislocation tangles i.e., thermally stable or fixed, with pinning accomplished by alloying elements in solution or vacancies attendant to alloying elements in solution. The matrix between dislocation tangles consists of individual regions having lower content of alloying additions and low density of dislocations.

In addition the present invention is characterized by improved workability of the alloys as shown, for example by a significant decrease in edge cracking during rolling which thereby results in considerable reduction in generation of scrap with attendant cost savings.

The present invention will be more readily understandable from a consideration of the following illustrative examples.

EXAMPLE I

In the following examples an alloy of the following composition was employed: Si - 0.08%; Cu - 0.44%; Mn - 0.77%; Cr - 0.10%; Mg - 2.9%; Zn - 0.02%; Fe - 0.17%; Ti - 0.01%. All of the alloys were Direct Chill cast and samples 1.75 inches thick were cut for processing according to the present invention.

EXAMPLE II

Samples of the alloy of Example I were hot rolled to 0.500 inch thick and cooled to room temperature. The samples were then cold rolled to 0.035 inch thick. The tensile strength after processing was found to be 65,200, psi, the yield strength 64,200 psi, at 0.2% offset, and the elongation 2%.

EXAMPLE III

Samples of the alloy of Example I were hot rolled to 0.500 inch thick. The samples were then cooled to room temperature, cold rolled to 0.125 inch, heated at about 290°F for about 2½ hours and cooled to room temperature. Then samples were then cold rolled to 0.035 inch and then heated at about 290°F for about 2½ hours.

The tensile strength after processing was found to be 64,500 psi, the yield strength 59,800 psi at 0.2% offset, and the elongation 7%.

EXAMPLE IV

Samples of the alloy of Example I were hot rolled to 0.500 inch thick cooled to room temperature, cold rolled to 0.125 inch, heated at about 290°F for about 2½ hours, and cooled to room temperature. The samples were then cold rolled to 0.080 inch, heated at about 290°F for about 2½ hours, cooled to room temperature, cold rolled to 0.035 inch and heated at about 290°F for about 2½ hours.

The tensile strength after processing was found to be 65,900 psi, the yield strength 61,400 psi at 0.2% offset, and the elongation 5.5%.

EXAMPLE V

As a comparative example to Example II, samples of the alloy of Example I were machined to 0.500 inch thick. The samples were then cold rolled to 0.125 inch, heated at about 290°F for about 2½ hours, cooled to room temperature, and then cold rolled to 0.035 inch thick.

The tensile strength after processing was found to be 72,000 psi, the yield strength 71,900 psi at 0.2% offset and the elongation of essentially 0%.

EXAMPLE VI

As a comparative example to Example III, samples of the alloy of Example I were machined to 0.500 inch thick, cold rolled to 0.125 inch, annealed at about 290°F for about 2½ hours and then cooled to room temperature. Samples were then cold rolled to 0.035 inch and then annealed at about 290°F for about 2½ hours.

Tensile strength after processing was found to be 67,100 psi, yield strength 62,600 psi and 0.2% offset and the elongation 5%.

EXAMPLE VII

As a comparative example to Example IV, samples of the alloy of Example I were machined to 0.500 inch thick, cold rolled to 0.125 inch, heated at about 290°F for about 2½ hours and cooled to room temperature. The samples were then cold rolled to 0.080 inch heated at about 290°F, cooled to room temperature, cold rolled to 0.035 inch and heated at about 290°F for about 2½ hours.

Tensile strength after processing was found to be 67,500 psi, yield strength 62,700 psi at 0.2% offset and the elongation 5%.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the means and range of equivalency are intended to be embraced therein.

What is claimed is:

1. A process for the preparation of aluminum having high strength and high ductility, comprising:

A. providing an aluminum base alloy containing from 0.05 to 1.0% iron, from 0.05 to 1.0% silicon, at least one material selected from the group consisting of less than 10.0% magnesium, less than 3.0% manganese, less than 1.0% copper, less than 0.5% chromium, less than 0.5% zinc, less than 0.5% zirconium, less than 0.5% titanium, less than 0.1% boron, others less than 0.5% each, total less than 1.5% balance essentially aluminum;

B. working said alloy, preferably by rolling or drawing, at a temperature between 450°F and 950°F with a total reduction in excess of 20%;

C. working said alloy, preferably by rolling or drawing, at a temperature below 450°F with a total reduction in excess of 20%;

D. holding said alloy at a temperature of from 250 to 650°F for a period of time no greater than defined in the following formula: $T(8.95 + \log t) = 5{,}700$, wherein T is temperature in degrees Kelvin and t is the maximum time in minutes at temperature T, so that there is no recrystallization throughout the matrix and so ther there is less than 10% loss in tenxile strength; and E. repeating step C, thereby resulting in an alloy having a subgrain size of less than 0.001 mm with the subgrain walls being formed of pinned dislocation tangles.

2. A process according to claim 1 wherein steps (C) and (D) are repeated.

3. A process according to claim 1 wherein step (C) and (D) are repeated a plurality of times.

4. A process according to claim 1 wherein working of step (B) is from 550° to 850°F.

5. A process according to claim 1 wherein the materials in step (A) are present in the following amounts: silicon from 0.3 to 0.7%, iron from 0.4 to 0.8%, at least one material selected from the group consisting of copper from 0.1 to 0.5%, manganese up to 1.6%, magnesium up to 5.0%, chromium up to 0.2%, zinc up to 0.3%, titanium up to 0.2%, zirconium up to 0.3% and boron up to 0.05%.

6. A process according to claim 1 wherein prior to said hot working step (B) the material is homogenized at a temperature above 850°F for at least 4 hours.

7. A process according to claim 4 wherein after said hot rolling step the material is rapidly cooled to below 450°F.

8. A process according to claim 1 wherein step (B) is rolling at a temperature below 200°F.

* * * * *

UNITED STATES PATENT AND TRADEMARK OFFICE

CERTIFICATE OF CORRECTION

PATENT NO. : 3,945,860

DATED : March 23, 1976

INVENTOR(S) : Joseph Winter, Michael J. Pryor, & William C. Setzer

It is certified that error appears in the above-identified patent and that said Letters Patent are hereby corrected as shown below:

In the Title: "PROCESS FOR OBTAINING HIGH DUCTILITY HIGH STRENGTH ALUMINUM BASE ALLOYS" should read ---PROCESS FOR PREPARING ALUMINUM BASE ALLOYS OF HIGH DUCTILITY AND HIGH STRENGTH---.

Column 1, the title "PROCESS FOR OBTAINING HIGH DUCTILITY HIGH STRENGTH ALUMINUM BASE ALLOYS" should read ---PROCESS FOR PREPARING ALUMINUM BASE ALLOYS OF HIGH DUCTILITY AND HIGH STRENGTH---;

Column 1, line 9, after the word "aluminum" insert ---base---.

Column 2, line 41, the word "about" should read ---from---.

Column 3, line 60, the word "materials" should read ---material---.

Column 6, line 25, the word "means" should read ---meaning---;

Column 6, line 38, after "1.5%" insert a comma (,);

Column 6, line 51, the word "ther" should read ---that---;

Column 6, line 52, the word "tenxile" should read ---tensile---;

Column 6, line 62, after "step (B) is" insert ---effected at---.

Column 8, line 4, "(B)" should read ---(C)---.

Signed and Sealed this

*fifteenth* Day of *June 1976*

[SEAL]

*Attest:*

RUTH C. MASON
*Attesting Officer*

C. MARSHALL DANN
*Commissioner of Patents and Trademarks*